US005513584A

United States Patent [19]

Rodriguez et al.

[11] Patent Number: 5,513,584

[45] Date of Patent: May 7, 1996

[54] PROCESS FOR THE IN-SITU PRODUCTION OF A SORBENT-OXIDE AEROSOL USED FOR REMOVING EFFLUENTS FROM A GASEOUS COMBUSTION STREAM

[75] Inventors: Domingo Rodriguez, Miranda; Jose Carrazza, Caracas, both of Venezuela

[73] Assignee: Intevep, S.A., Caracas, Venezuela

[21] Appl. No.: 498,952

[22] Filed: Mar. 26, 1990

Related U.S. Application Data

[60] Continuation-in-part of Ser. No. 263,896, Oct. 28, 1988, Pat. No. 4,923,483, which is a division of Ser. No. 96,643, Sep. 11, 1987, Pat. No. 4,795,478, which is a continuation-in-part of Ser. No. 14,871, Feb. 17, 1987, Pat. No. 4,834,775, which is a continuation-in-part of Ser. No. 875,450, Jun. 17, 1986, Pat. No. 4,801,304, and a continuation-in-part of Ser. No. 342,148, Apr. 24, 1989, Pat. No. 4,976,745, which is a continuation-in-part of Ser. No. 133,323, Dec. 16, 1997, Pat. No. 4,824,439, which is a continuation-in-part of Ser. No. 14,871.

[51] Int. Cl.[6] ..... F23B 7/00; F23J 7/00

[52] U.S. Cl. ..... 110/342; 110/345; 431/4; 44/280; 44/301

[58] Field of Search ..... 44/457, 301, 280; 423/635, 636; 252/305; 110/342, 345; 431/4

[56] References Cited

U.S. PATENT DOCUMENTS

| | | | |
|---|---|---|---|
| 2,454,733 | 11/1948 | Dahl | 423/636 |
| 3,002,825 | 10/1961 | Norris | 44/301 |
| 3,047,057 | 7/1962 | Caryle | 252/305 |
| 3,540,866 | 11/1970 | Miller | 44/301 |
| 3,687,625 | 8/1972 | Terrana et al. | 423/636 |
| 3,746,498 | 7/1973 | Stengel | 431/4 |
| 3,848,068 | 11/1974 | Rice | 423/636 |
| 3,980,449 | 9/1976 | Zetlmeisl et al. | 44/68 |
| 4,116,610 | 9/1978 | Berthiaume | 44/301 |
| 4,335,084 | 6/1982 | Brogan | 110/345 |
| 4,375,359 | 3/1983 | Chapman et al. | 44/51 |
| 4,427,362 | 1/1984 | Dykema | 431/4 |
| 4,447,203 | 5/1984 | Hampton et al. | 431/4 |
| 4,503,785 | 3/1985 | Scocca | 44/4 |
| 4,512,774 | 4/1985 | Myers | 44/51 |
| 4,517,165 | 5/1985 | Moriarty | 423/244 |
| 4,520,741 | 6/1985 | Carbeau | 110/344 |
| 4,542,704 | 9/1985 | Brown et al. | 110/345 |
| 4,574,078 | 3/1986 | Cortesi et al. | 423/592 |
| 4,721,610 | 1/1988 | Yoshida et al. | 423/636 |
| 4,749,382 | 6/1988 | Collins et al. | 44/53 |
| 4,786,490 | 11/1988 | Yoshida et al. | 423/636 |
| 4,801,304 | 1/1989 | Polanco | 44/301 |
| 4,824,439 | 4/1989 | Polanco | 44/301 |
| 4,832,701 | 5/1989 | Polanco | 44/301 |
| 4,842,832 | 6/1989 | Inoue | 423/211 |
| 4,922,840 | 5/1990 | Woodroffee et al. | 110/345 |

*Primary Examiner*—Margaret Medley
*Attorney, Agent, or Firm*—Bachman & LaPointe

[57] ABSTRACT

A process for the in-situ production of an effluent sorbent-oxide aerosol during the combustion of a hydrocarbon containing fuel whereby the effluents are removed from the resultant gaseous hydrocarbon stream comprises admixing an aqueous solution of the sorbent with the fuel, atomizing and combusting the mixture under controlled conditions so as to generate the effluent sorbent-oxide aerosol.

12 Claims, 5 Drawing Sheets

PROCESS FOR THE IN-SITU PRODUCTION OF A SORBENT-OXIDE AEROSOL USED FOR REMOVING EFFLUENTS FROM A GASEOUS COMBUSTION STREAM

CROSS REFERENCE TO RELATED APPLICATIONS

This application is related to application Ser. No. 07/498,892, filed concurrently herewith on Mar. 26, 1990, now abandoned.

This application is a continuation-in-part of application Ser. No. 263,896, filed Oct. 28, 1988 which issued on Oct. 28, 1988 as U.S. Pat. No. 4,923,483, which is a division of application Ser. No. 096,643, filed Sep. 11, 1987, which issued on Jan. 3, 1989 as U.S. Pat. No. 4,795,478, which in turn is a continuation-in-part of application Ser. No. 014,871, filed Feb. 17, 1987, which issued on May 30, 1989 as U.S. Pat. No. 4,834,775, which in turn is a continuation-in-part of application Ser. No. 875,450, filed Jun. 17, 1986, which issued on Jan. 31, 1989 as U.S. Pat. No. 4,801,304. This application is also a continuation-in-part of application Ser. No. 342,148, filed Apr. 24, 1989 which issued on Dec. 11, 1990 as U.S. Pat. No. 4,976,745, which is a continuation-in-part of application Ser. No. 133,323, filed Dec. 16, 1987, which issued on Apr. 25, 1989 as U.S. Pat. No. 4,824,439 which in turn is a continuation-in-part of the aforementioned application Ser. No. 014,871, filed Feb. 17, 1987, which issued on May 30, 1989 as U.S. Pat. No. 4,834,775.

BACKGROUND OF THE INVENTION

The present invention relates to a process for the in-situ production of a sorbent-oxide aerosol used for removing effluents from a gaseous combustion stream and, more particularly, a process for the production of a metal oxide sorbent which absorbs sulfur and other effluents from a hydrocarbon fuel combustion stream.

Gaseous combustion streams are the source of many undesirable effluents discharged into the environment which result in atmospheric pollution. The undesirable effluents include, for example, sulfur, nitrogen, flourine and a host of other undesirable effluents. Particularly harmful to the environment are the undesirable effluents which result from the combustion of hydrocarbon containing fossil fuels.

Heretofore, many mechanisms have been proposed for removing effluents from combustion streams. In the case of sulfur, nitrogen and other like effluents it is common practice to scrub the gaseous streams. In addition, in-furnace limestone injection has been commonly employed. Neither of these processes tend to be cost effective on a commercial level.

Naturally, it would be highly desirable to provide a mechanism for removing effluents from industrial combustion streams in an economic manner.

Accordingly, it is a principal object of the present invention to provide a process for removing environmental harmful effluents from a gaseous stream.

It is a particular object of the present invention to provide a process for the production of a sorbent material suitable for removing effluents from a gaseous combustion stream.

It is a further object of the present invention to provide a process for the in-situ production of a sorbent-oxide aerosol for removing effluents from a gaseous combustion stream which is effective and economical.

It is a still further object of the present invention to provide a process for the production of a sorbent-oxide stream useful for removing sulfur and other effluents from a gaseous hydrocarbon fuel combustion stream.

Further objects and advantages of the present invention will appear hereinbelow.

SUMMARY OF THE INVENTION

In accordance with the present invention, the foregoing objects and advantages are readily obtained.

The present invention is drawn to a process for the production of a sorbent-oxide aerosol used for removing effluents from a gaseous combustion stream. It is a particular feature of the present invention to produce a sulfur sorbent metal-oxide aerosol for removing sulfur from a gaseous hydrocarbon fuel combustion stream. The process of the present invention comprises forming an aerosol of an effluent sorbent in the form of ultra-fine sorbent-oxide particles having preferably a mean diameter of submicron size in-situ during the combustion of a hydrocarbon containing fossil fuel and contacting the gaseous combustion stream containing the effluents with the aerosol so that the sorbent-oxide particles absorb the effluents from the gaseous stream. In a preferred process of the present invention, a hydrocarbon containing fuel is admixed with an aqueous solution consisting essentially of a dissolved effluent sorbent compound so as to form a combustible fuel mixture. The combustible fuel mixture is atomized under controlled conditions and fed to a combustion zone in the presence of an oxidant. Alternatively, the hydrocarbon fuel and aqueous solution of effluent sorbent compound may be fed separately to the combustion zone and be admixed therein; however, admixing prior to feeding is preferred. The combustible fuel mixture and oxidant are combusted in the combustion zone under controlled temperature conditions $T_1$ so as to obtain an aerosol of the sorbent in the form of ultra-fine sorbent-oxide particles having preferably a mean diameter of submicron size in the gaseous combustion stream. The gaseous combustion stream is thereafter cooled to a temperature $T_2$, where $T_2$ is less than $T_1$, so as to allow the sorbent-oxide particles to absorb the effluents from the combustion stream. In accordance with various embodiments of the present invention, the oxidant can be introduced at flame level or a portion of the oxidant may be introduced into the gaseous combustion stream downstream of the combustion zone in a stepwise manner which results in improved effluent absorption. In accordance with the process of the present invention, the combustion flame temperature, oxidant introduction and atomizing conditions are controlled so as to insure the production of a submicron sized sorbent-oxide particle.

DETAILED DESCRIPTION

The present invention relates to a process for removing effluents from a gaseous combustion stream and, more particularly, a process for the in-situ production of a sorbent-oxide aerosol during the combustion of a hydrocarbon whereby effluents are removed from the resultant gaseous hydrocarbon combustion stream.

Figure 1:
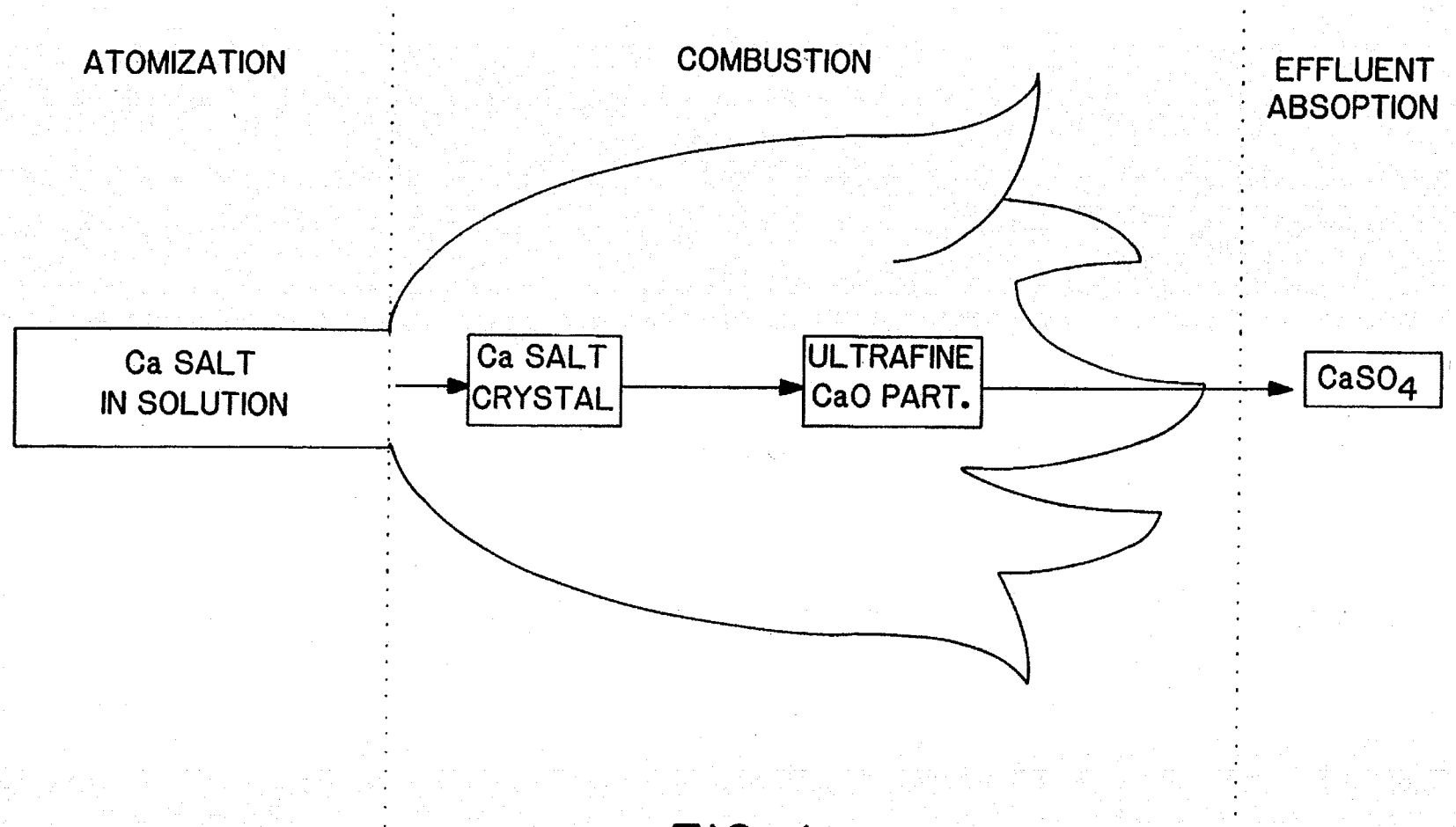
FIG. 1 is a schematic illustration of the process of the present invention employing a Ca salt as the water soluble effluent sorbent compound for the in-situ product of the effluent sorbent-oxide aerosol.

With reference to FIG. 1, the mechanism of the process of the present invention will be discussed in detail. An aqueous solution of a dissolved effluent sorbent compound is admixed with a hydrocarbon containing fossil fuel to form a combustible fuel mixture. The amount of sorbent in the aqueous solution and the volume of aqueous solution mixed with the fossil fuel is dependent on the nature and amount of effluent bearing material which is present in the fuel. In the case of sulfur, for example, the molar ratio of sorbent to sulfur in the fuel mixture may be up to 2.5 and preferably is between about 0.6 to 1.2 depending on the particular sorbent used. In the case of nitrogen, the ratio would be substantially the same as for sulfur given above. In accordance with the present invention, the effluent sorbent compound is in the form of a metal salt selected from the group consisting of alkaline, alkaline earth or other metal salts wherein the metals have the same or higher valence than the alkaline earth metals. Preferred metals are Ca and Mg with Ca being the ideal. Particularly suitable calcium metal salt compounds are $CaCl_2$, $Ca(NO_3)_2$, $Ca(CH_3COO)_2$, $Ca(C_2H_5COO)_2$, $Ca(CHOO)_2$, $Ca(OH)_2$, CaO and mixtures thereof. Similar magnesium compounds may be employed. The addition of solubility enhancing compounds to the water that raise the solubility of the metal salt, such as sucrose, glycerol, alcohols, and the like improves the performance of the process. In the case of water insoluable metal salt compounds such as $Ca(OH)_2$ and CaO solubility enhancing compounds are required to dissolve the salts in order to form the aqueous solution. The solubility enhancing compound is employed in an amount sufficient to take all of the metal salt into aqueous solution.

The fuel mixture as described above is fed to a nozzle where the fuel is atomized under controlled conditions with or without an atomizing gas, preferably with an atomizing gas. Suitable atomizing gases include air, steam, $N_2$, $O_2$, Ar, He, with air, steam, $N_2$ being preferred. Atomization, as will be demonstrated in the examples hereinbelow, tends to have a strong effect on the particle size of the resultant sorbent-oxide produced and, ultimately, the degree of effluent absorption. During fuel atomization, the fuel mixture is transformed into small droplets. By controlling atomizing conditions, droplet size is controlled which, it has been found, controls the particle size of the sorbent-oxide ultimately produced in the process of the present invention. As noted above, it is preferred to atomize the fuel mixture with an atomizing gas. The mass ratio of gas to fuel mixture should be greater than or equal to 0.05 preferably greater than or equal to 0.10 and ideally between about 0.15 and 3.00 in order to obtain the desired sorbent oxide particle size as set forth hereinbelow and demonstrated by the examples and experimental work.

The atomized fuel mixture is thereafter combusted in a combustion zone in the presence of an oxidant under controlled conditions. During combustion, it is believed that small solid crystals of the sorbent are formed after evaporation of the water. These crystals then decompose at the combustion flame temperature $T_1$ and ultra-fine particles of sorbent-oxide are generated in the gaseous combustion stream. The combustion temperature $T_1$, namely the adiabatic flame temperature may be controlled in order to achieve the desired combustion of the fuel and formation of the sorbent. At elevated flame temperatures there is a tendency for a coalescense effect which has an adverse effect on the sorbent-oxide particle size. At the same time, the temperature must be sufficiently high to obtain sufficient fuel utilization and sorbent generation. In order to effectively carry out the process of the present invention, the combustion temperature $T_1$ is between about 1400° K to 2450° K, preferably 1900° K to 2200° K.

In order to obtain effective combustion, the oxidant must be present in an amount at least equal to the stoichiometric amount with respect to the fuel oil and preferably in an amount greater than the stoichiometric amount and up to 1.1 times the stoichiometric amount. It has been found that the process of the present invention may be improved by feeding the oxidant in a stepwise manner, that is, a portion to the combustion zone, i.e. flame, and a portion downstream of the combustion zone at a desired temperature. The oxidant is fed to the combustion zone and downstream thereof, with respect to total oxidant employed, of between about 60% to 95% and 5% to 40%, respectively, preferably 80% to 90% and 10% to 20%, respectively. The oxidant introduced downstream of the combustion zone should be introduced at a temperature of between about 1400° K to 2200° K, preferably 1400° K to 1600° K in order to obtain best results with respect to complete combustion of the fuel and formation of the sorbent to obtain the desired sorbent-oxide particles.

The resultant aerosol from the combustion of the atomized fuel mixture, that is the sorbent-oxide particles carried in the gaseous hydrocarbon combustion stream, is characterized by an ultra-fine sorbent-oxide particle having preferably a mean diameter of submicron size and ideally less than or equal to 0.5 μm. The combustion stream is cooled in a controlled manner through a desired temperature range $T_2$ in order to allow the sorbent-oxide particles to react with and absorb the effluent from the combustion stream. The temperature range $T_2$ is between about 1350° K to 700° K, preferably 1350° K to 1000° K. The gaseous combustion stream should remain within the temperature range $T_2$ for a period of greater than 0.10 seconds and preferably greater than 0.50 seconds in order to insure effective sorbent utilization and effluent capture. It is preferred that sorbent utilization be greater than or equal to about 35%, ideally 50%. Sorbent utilization is defined as follows:

$$\text{\% sorbent utilized} = 100 \times \frac{\left(\dfrac{[\text{effluent}]\text{baseline} - [\text{effluent}]\text{sorbent}}{[\text{efflent}]\text{baseline}}\right)}{\dfrac{1}{\alpha}\left(\dfrac{\text{moles sorbent}}{\text{moles effluent}}\right)}$$

where α is the stoichiometric coefficient in the sorbent and effluent chemical reaction and [effluent]baseline is the concentration of effluent in the dry emission gases in the absence of a sorbent.

The following examples illustrate specific features of the process of the present invention but in no way are intended to be limiting.

EXAMPLE I

In order to demonstrate and quantify the existance of unwanted effluents, namely sulfur, in a hydrocarbon fuel combustion stream, a No. 6 fuel oil having a sulfur content of 2% by weight and a heating value of 17,000 BTU/lb. was combusted in a furnace. The fuel oil was fed to the furnace through a commercially available nozzle and was atomized with $N_2$ (nitrogen) in a mass ratio of $N_2$ to No. 6 fuel oil of 1.0. The fuel was combusted with air at a firing rate of 56,000 BTU/hr. until completely combusted. The concentration of $SO_2$ in the dry emission gases was then measured. By dry emission gases is meant all the gases produced during the combustion process, with the exception of $H_2O$, corrected to a zero percent oxygen. The concentration was found to be 2000 ppm.

In order to demonstrate what effect an aqueous mixture of the hydrocarbon would have on $SO_2$ emissions, the run described above was repeated with the No. 6 fuel oil mixed with water. The fuel oil was present in an amount of 86% by weight, balance water. The fuel oil and water were admixed with the aid of an in-line mixer and fed to the furnace, atomized with $N_2$ in the same manner as previously described and combusted with air at a firing rate of 56,000 BTU/hr. The concentration of $SO_2$ in the dry emission gases was again 2000 ppm thereby demonstrating that the addition of water per se to the fuel oil prior to combustion did not have any effect on the concentration of $SO_2$ emissions in the combustion gases.

EXAMPLE II

A further experiment was conducted to demonstrate the effectiveness of the process of the present invention on removing effluents from a gaseous hydrocarbon fuel combustion stream. The experiment was similar to those run in Example I above with the exception that the No. 6 fuel oil was admixed with a 34 weight percent aqueous solution of $CaCl_2$ so as to yield a mixture comprising 77% by weight No. 6 fuel oil. The molar ratio of Ca to S was equal to 1.0. This fuel mixture was atomized and combusted in the same manner as described above with reference to Example I.

The concentration of $SO_2$ in the dry emission gases was measured and was found to be 960 ppm which represents a 52% reduction in $SO_2$ emissions when compared to Example I above. Based on elemental analysis, the solids produced during this experiment contained a sulfur to calcium molar ratio of 0.52. This experiment indicates that the addition of the $CaCl_2$ aqueous solution prior to combustion caused a greater than 35% reduction in the concentration of $SO_2$ in the dry emission gases, that is, a 52% $SO_2$ reduction, which can be associated with the reaction with S of more than 35% of the Ca injected, i.e., a greater than 35% calcium utilization. This is derived from the equation set forth below in Example IV.

EXAMPLE III

In order to demonstrate the effect atomization of the fuel mixture has on effluent emissions, the experiment of Example II was repeated with the fuel mixture being atomized with $N_2$ in a mass ratio of $N_2$ to fuel mixture of 2.5, that is, 2.5 times greater than the mass ratio of Example II. The mixture was combusted in air at a firing rate of 56,000 BTU/hr. as was the case in Example II.

The $SO_2$ concentration in the dry emission gases was measured and was found to be 300 ppm. This value represents an 85% reduction in $SO_2$ emissions when compared with run 2 of Example I, where no Ca salt was dissolved in the water. This value also represents a further reduction in $SO_2$ emission when compared with Example II where the same amount of calcium was employed but where the fuel mixture was atomized at a lower $N_2$ to fuel oil mass ratio.

Scanning-electron micrographs of the solids collected from Examples II and III show that in the latter case, when the atomizing fluid to fuel ratio is higher and the $SO_2$ emissions are lower, the concentration of submicron sorbent particles produced was much higher than in the former case. In the former an important fraction of the sorbent particles (between 30 and 50%) have a mean diameter higher than 5 μm, while in the latter most of them (more than 80%) were submicron sized. This demonstrates that good atomization increases the density of small particles which, it is believed, effects effluent emission removal as shown above. The increase in density of small particles increases the surface area of the sorbent and, correspondingly, the ability to absorb effluents.

EXAMPLE IV

A further experiment was conducted employing 27.2% by weight calcium acetate aqueous solution added to the No. 6 fuel oil of the previous examples so that the fuel oil represented 83% by weight of the fuel mixture, and the calcium to sulfur molar ratio was equal to 0.56. The mixture was combusted with air in the same facility as in Example I. The mixture was atomized with $N_2$, at a $N_2$ to fuel mass ratio of 2.3. The $SO_2$ concentration in the dry emission gases were measured and found to be 1502 ppm, which corresponds to a percentage of calcium utilization equal to 44.5%, as given by the equation:

$$\%\ \text{Ca util} = 100 \times \frac{\left(\dfrac{[SO_2]_{baseline} - [SO_2]_{sorbent}}{[SO_2]_{baseline}}\right)}{\dfrac{1}{\alpha}\left(\dfrac{\text{moles Ca}}{\text{moles S}}\right)}$$

$$\text{where } \alpha = 1, \frac{\text{moles Ca}}{\text{moles S}}$$

is the calcium to sulfur molar ratio, which in this case is 0.56, the $[SO_2]_{baseline}$ is the concentration of $SO_2$ in the dry emission gases in the absence of a Ca salt dissolved in the water, which is equal to 2000 ppm, as indicated by experiment 2 in Example I, and $[SO_2]_{sorbent}$ is the concentration of $SO_2$ in the dry emission gases when a Ca salt dissolved in water is injected with the fuel, which in the particular case of this example is equal to 1502 ppm.

A scanning electron micrograph of the solids produced indicates that most of the sorbent particles produced were cubic crystals of submicron size. A particle size distribution of the solids shows that the volume mean diameter of the particles is between 0.3 and 0.4 μm.

This example again demonstrates the effectiveness of the process of the present invention.

EXAMPLE V

A further experiment was conducted employing a coal-water slurry as the hydrocarbon fuel. The coal-water slurry was combusted in a furnace under conditions similar to those described for the experiment 1 in Example I, and the $SO_2$ concentration in the dry gases was found to be 2000 ppm.

In a similar experiment an aqueous solution containing calcium acetate in a 27.2% by weight concentration was mixed with the coal-water slurry with the aid of an in-line mixer as described in the previous examples. The amount of calcium acetate solution added was such that the molar ratio of calcium in the solution to sulfur in the coal-water slurry was equal to 1.0. The mix was fired under the same conditions as described above in Example I and the $SO_2$ concentration in the dry gases was found to be 800 ppm which, according to the equation described in the previous example, represents a 60% calcium utilization.

As in the previous example, a scanning electron micrograph of the solids produced indicated that most of the sorbent particles produced were crystals of submicron size.

This example demonstrates that the process of the present invention is equally effective in the removal of sulfur effluents from combustion gases produced during combustion of either solid or liquid hydrocarbons.

EXAMPLE VI

A further pair of experiments were conducted to demonstrate the effect of oxidant introduction on effluent removal. In both experiments a fuel mixture of the No. 6 fuel oil and a 27.2% by weight calcium acetate was prepared such that the molar ratio of Ca to S was 1.0. The combustion conditions were identical to those described above with the exception that in experiment 1 all of the oxidant, in this case air, was introduced with the fuel/Ca-solution mixture at the top of the furnace, while in experiment 2, 75% of the air was injected with the aforesaid mixture, and the other 25% was injected downstream of the furnace, at a temperature of 1530 ° K.

In experiment 1, a 30% Ca utilization was obtained which, according to the equation described in the previous example, corresponds to a 30% reduction in $SO_2$ emission. In experiment 2, a 60% Ca utilization was obtained, corresponding to a 60% reduction in $SO_2$ emission.

This example clearly shows that with an adequate injection of oxidant into the furnace, the capabilities of the Ca salt to reduce the $SO_2$ emissions in the combustion process can be strongly enhanced in a two-stage process.

EXAMPLE VII

In a further experiment the same kind of fuel oil No. 6 used in Example I was mixed with a $Ca(OH)_2$ slurry, so that fuel oil represents 81% by weight of the mixture, $Ca(OH)_2$ 6% by weight with balance water. The molar ratio of $Ca(OH)_2$ to sulfur in the fuel oil in the mixture is equal to 1.0, and the weight ratio of fuel oil to water was the same as that of the mixture used in experiment 2 of Example I. This mixture was prepared and combusted under the same conditions as in Example I, and the $SO_2$ concentration in the dry emission gases was equal to 1680 ppm. Since the combustion of such mixture without the addition of $Ca(OH)_2$ generates an $SO_2$ concentation of 2000 ppm, the percentage of calcium utilization in this experiment is equal to 16%, according to the formula described in Example IV, above.

In a similar experiment, sucrose was added to the $Ca(OH)_2$ slurry prior to the mixing with the fuel oil. The sucrose enables the $Ca(OH)_2$ to be dissolved in water, and in this case, sucrose was used in an amount to insure all the $Ca(OH)_2$ dissolved and a homogeneous solution of $Ca(OH)_2$ and sucrose in water was produced. This solution was mixed with fuel oil No. 6 in proportions so that the molar ratio of calcium to sulfur was equal to 1.0 and the weight ratio of fuel oil to water is the same as in the previous experiment. This mixture was combusted under the same conditions as in the previous experiment, and the $SO_2$ concentration in the dry emission gases was found to be 1300 ppm, which represents a 35% calcium utilization.

In a third experiment, a solution of sucrose in water of the same concentration as in the previous experiment was mixed with fuel oil, so that the weight ratio of fuel oil to water was the same as above. The combustion of this mixture resulted in a 2000 ppm $SO_2$ concentration in the dry emission gases, indicating that the addition of sucrose by itself to the mixture does not cause any reduction of the $SO_2$ concentration in the effluent gases.

This example shows that the addition of a compound to the water that enhances the solubility of the calcium salt improves the effectiveness of the sorbent generated for removal of effluents from a gaseous combustion stream.

Based on the results of the foregoing examples and additional experimental work, the predicted effect of (1) sorbent-oxide particle size, (2) atomization, (3) flame temperature, and (4) two stage feeding of the oxidant was determined. The results are graphically illustrated in FIGS. 2 through 5.

Figure 2:
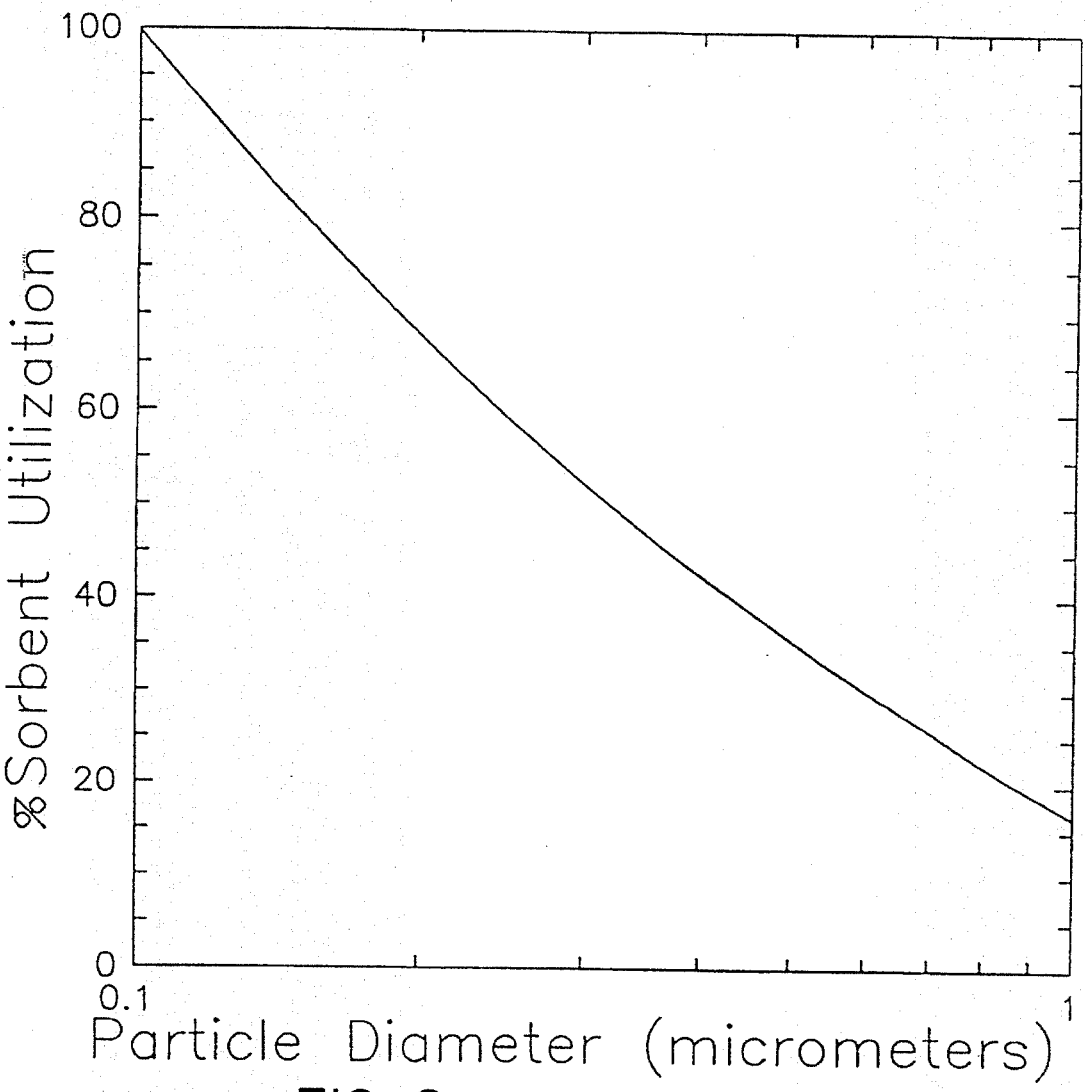
FIG. 2 is a graph illustrating the effect of sorbent-oxide particle size on sulfur capture.

FIG. 2 demonstrates the effect of sorbent-oxide particle size on sulfur capture where the sorbent employed is calcium. From FIG. 2, it is clear that as the particle size of the sorbent-oxide decreases the degree of sulfur capture increases. This is believed to be attributable to the increase in sorbent surface area achieved via small particle size.

Figure 3:
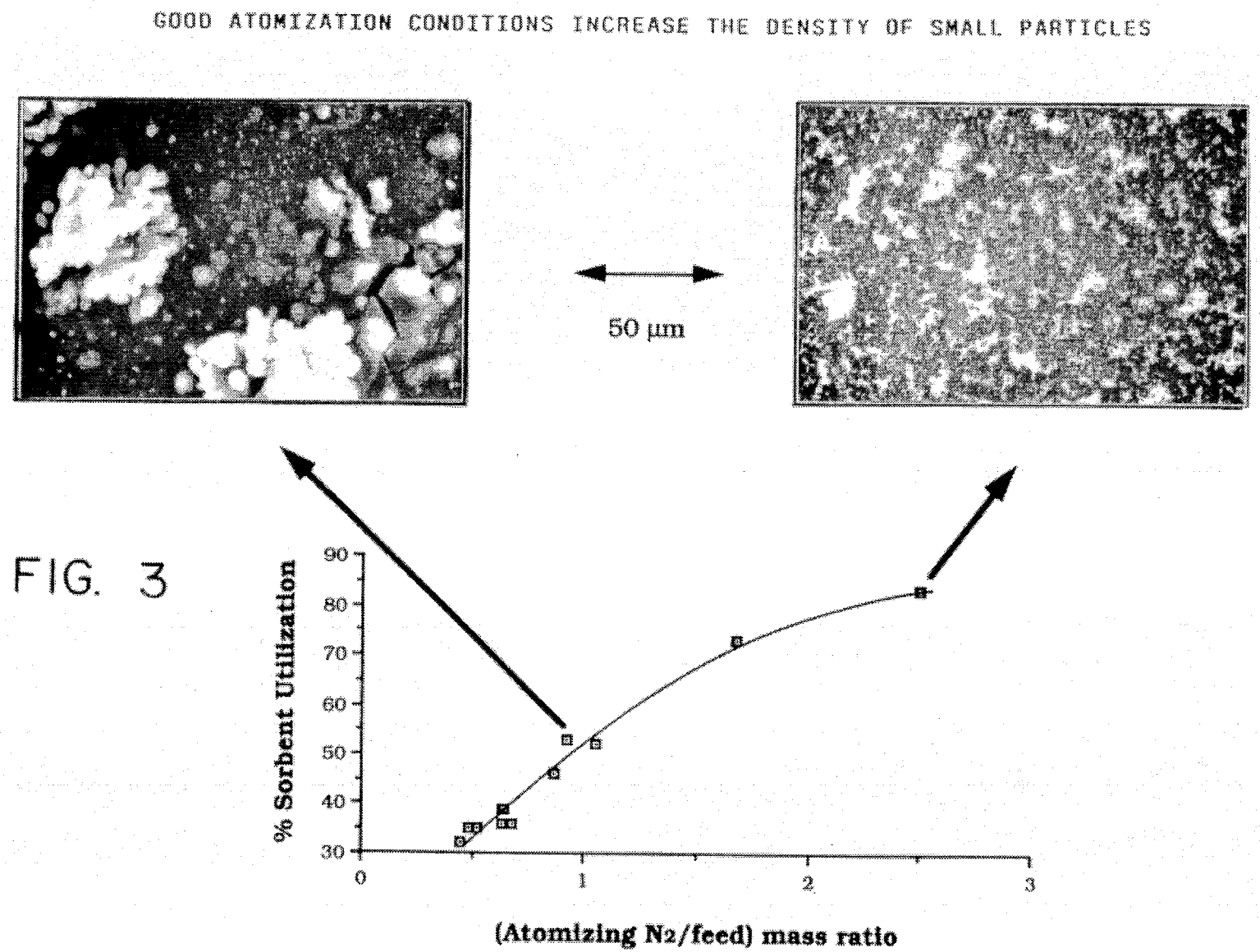
FIG. 3 is a graph illustrating the effect of atomization on sorbent-oxide particle size and sorbent utilization.

FIG. 3 illustrates the effect of atomization on sorbent-oxide particle size and sorbent utilization. As is clearly seen from the graph and photo-micrographs, as the mass ratio of atomizing gas to fuel mixture increases, the resultant sorbent-oxide particle size decreases and sorbent utilization increases and, therefore, effluent absorption.

Figure 4:
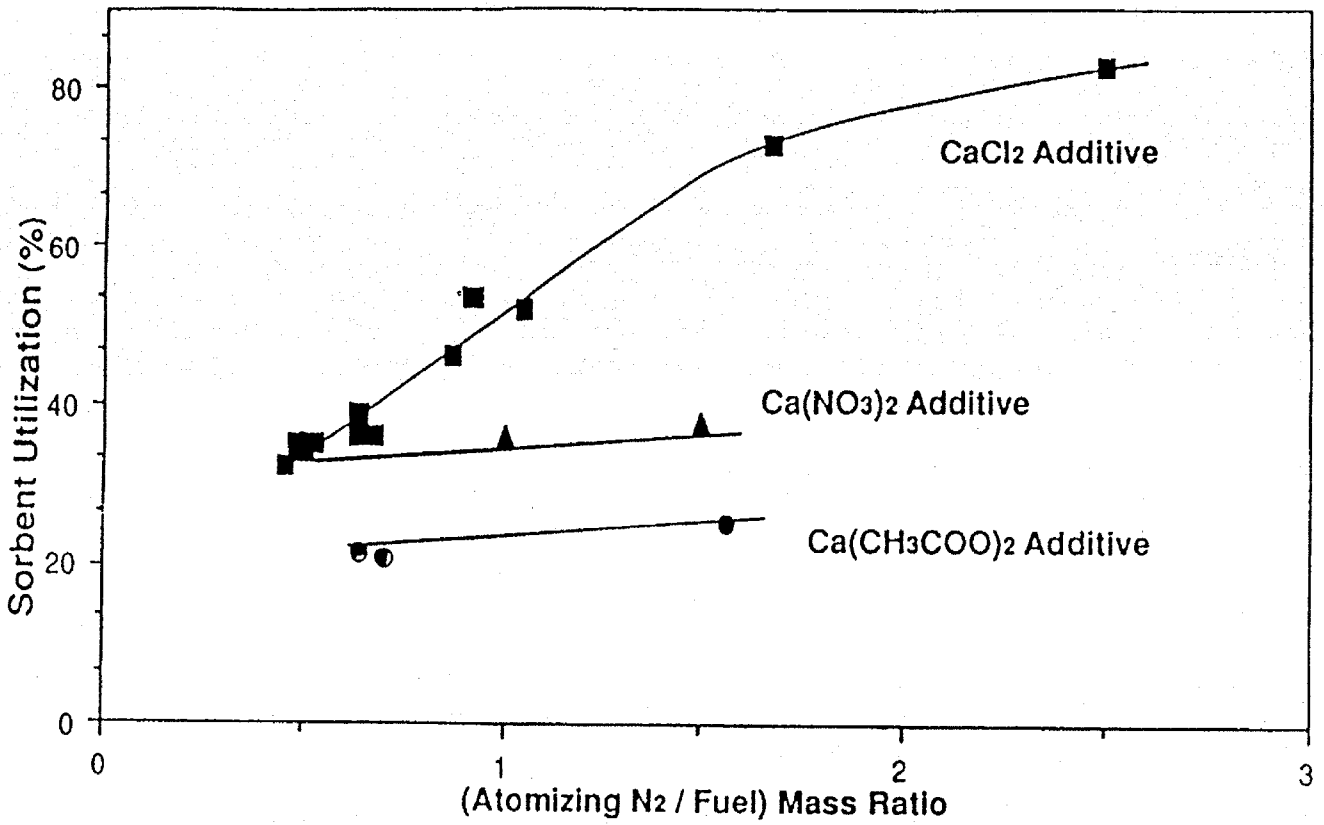
FIG. 4 is a further graph showing the effect of atomization on sorbent utilization and correspondingly effluent absorption.

FIG. 4 further demonstrates the effect of atomization on sorbent utilization for various sorbent materials. Again, as was the case above, sorbent utilization increases with an increase in atomizing mass ratio; however, the degree of effect is shown to be sorbent dependent.

Figure 5:
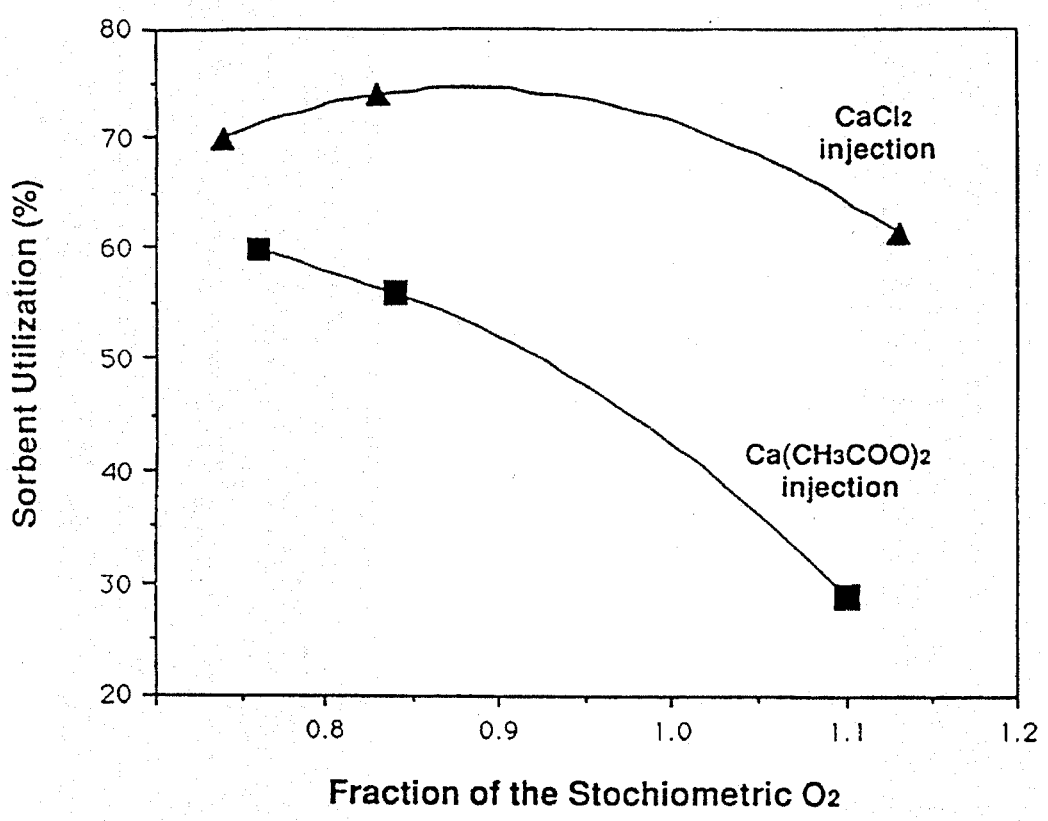
FIG. 5 is a graph illustrating the effect of stepwise oxidant introduction on sorbent utilization.

The effect of stepwise feeding of the oxidant is demonstrated illustratively in FIG. 5. As the amount of oxidant delivered to the combustion zone decreases and correspondingly downstream feeding increases, the sorbent utilization increases.

This invention may be embodied in other forms or carried out in other ways without departing from the spirit or essential characteristics thereof. The present embodiment is therefore to be considered as in all respects illustrative and not restrictive, the scope of the invention being indicated by the appended claims, and all changes which come within the meaning and range of equivalency are intended to be embraced therein.

What is claimed is:

1. A process for the in-situ production of an effluent sorbent-oxide aerosol during the combustion of a hydrocarbon containing fuel whereby effluents are removed from the resultant gaseous hydrocarbon combustion stream, comprising the steps of: (1) forming an aqueous solution comprising an effluent sorbent compound selected from the group consisting of $CaCl_2$, $Ca(CH_3COO)_2$, $Ca(CHOO)_2$, $Ca(OH)_2$ and mixtures thereof dissolved in water; (2) admixing the aqueous solution of the effluent sorbent with a hydrocarbon containing fuel so as to form a combustible fuel mixture; (3) atomizing said combustible fuel mixture and feeding said atomized fuel mixture to a combustion zone; (4) combusting said atomized fuel mixture in said combustion zone under controlled temperature conditions $T_1$ wherein $T_1$ is between about 1900° K to about 2200° K in the presence of an oxygen containing oxidant so as to obtain a sorbent-oxide aerosol comprising ultra-fine sorbent-oxide particles having a mean diameter of submicron size in said gaseous combustion stream; (5) partially cooling said combustion stream to a temperature $T_3$ of between about 1400° K to 1600° K downstream of the combustion zone; (6) feeding additional oxidant to said partially cooled gaseous stream downstream of the combustion zone at temperature $T_3$ wherein oxygen is present in greater than the stoichiometric ratio with said hydrocarbon fuel and wherein between about 60 to 95% of the total oxidant is fed to the combustion zone and between about 5 to 40% of the total oxidant is fed to said partially cooled gaseous stream; and (7) further cooling said gaseous combustion stream downstream of said combustion zone to a temperature $T_2$ wherein $T_2$ is between about 700° K to about 1350° K so that said sorbent-oxide particles absorb said effluents from said gaseous combustion stream.

2. A process according to claim 1 wherein said temperature $T_2$ is between about 1000° K to about 1350° K.

3. A process according to claim 1 wherein said sorbent-oxide particles have a mean diameter of about $\leqq 0.5$ μm

4. A process according to claim 1 wherein said fuel mixture is atomized by an atomizing fluid.

5. A process according to claim 1 wherein said hydrocarbon fuel contains sulfur which upon combustion forms a sulfurous by-product effluent in the form of $SO_x$.

6. A process according to claim 5 wherein said fuel mixture has a Ca to S ratio of up to 2.5.

7. A process according to claim 5 wherein said fuel mixture has a Ca to S ratio of between about 0.6 to 1.2.

8. A process according to claim 6 wherein at least 35% by weight of said sorbent is utilized in sulfur absorptions so as to obtain a sulfur reduction in the amount of at least 21% when compared to sorbent-free combustion processes.

9. A process according to claim 8 wherein said sorbent utilization is greater than 50%.

10. A process according to claim 1, further including the step of admixing a sorbent solubility enhancing compound in said aqueous solution forming step.

11. A process according to claim 10 wherein said sorbent solubility enhancing compound is selected from the group consisting of sucrose, glycerol, alcohols and mixtures thereof.

12. A process for the in-situ production of an effluent sorbent-oxide aerosol during the combustion of a hydrocarbon containing fuel whereby effluents are removed from the resultant gaseous hydrocarbon combustion stream, comprising the steps of: (1) providing a hydrocarbon containing fuel; (2) forming an aqueous solution comprising an effluent sorbent compound selected from the group consisting of $CaCl_2$, $Ca(CH_3COO)_2$, $Ca(CHOO)_2$, $Ca(OH)_2$ and mixtures thereof dissolved in water; (3) separately feeding said hydrocarbon fuel and aqueous solution to a combustion zone wherein said fuel and solution are admixed: (4) combusting said fuel mixture in said combustion zone under controlled temperature conditions $T_1$ wherein $T_1$ is between about 1900° K to about 2200° K in the presence of an oxygen containing oxidant so as to obtain a sorbent-oxide aerosol comprising ultra-fine sorbent-oxide particles having a mean diameter of submicron size in said gaseous combustion stream; (5) partially cooling said combustion stream to a temperature $T_3$ of between about 1400° K to 1600° K downstream of the combustion zone; (6) feeding additional oxidant to said partially cooled gaseous stream downstream of the combustion zone at temperature $T_3$ wherein oxygen is present in greater than the stoichiometric ratio with said hydrocarbon fuel and wherein between about 60 to 95% of the total oxidant is fed to the combustion zone and between about 5 to 40% of the total oxidant is fed to said partially cooled gaseous stream; and (7) further cooling said gaseous combustion stream downstream of said combustion zone to a temperature $T_2$ wherein $T_2$ is between about 700% to about 1350% so that said sorbent-oxide particles absorb said effluents from said gaseous combustion stream.

* * * * *

UNITED STATES PATENT AND TRADEMARK OFFICE

CERTIFICATE OF CORRECTION

PATENT NO. : 5,513,584

DATED : May 7, 1996

INVENTOR(S) : Domingo Rodriguez et al.

It is certified that error appears in the above-indentified patent and that said Letters Patent is hereby corrected as shown below:

Claim 12, line 33 of column 10 "700%" should be changed to --700$^{o}$K--.

Claim 12, line 34 of column 10 "1350%" should be changed to --1350$^{o}$K--.

Signed and Sealed this

Twenty-ninth Day of October 1996

*Attest:*

BRUCE LEHMAN

*Attesting Officer*

*Commissioner of Patents and Trademarks*